US009244393B1

(12) United States Patent
Inaba et al.

(10) Patent No.: US 9,244,393 B1
(45) Date of Patent: Jan. 26, 2016

(54) IMAGE FORMING METHOD

(71) Applicant: FUJI XEROX CO., LTD., Tokyo (JP)

(72) Inventors: Yoshihiro Inaba, Kanagawa (JP); Koji Horiba, Kanagawa (JP); Akira Imai, Kanagawa (JP); Masahiro Oki, Kanagawa (JP); Takako Kobayashi, Kanagawa (JP); Daisuke Yoshino, Kanagawa (JP); Hiroyuki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/597,063

(22) Filed: Jan. 14, 2015

(30) Foreign Application Priority Data

Aug. 12, 2014 (JP) ..... 2014-164283

(51) Int. Cl.
*G03G 15/20* (2006.01)

(52) U.S. Cl.
CPC ..... *G03G 15/2014* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,155,534 | A * | 10/1992 | Kurotori et al. | 399/237 |
| 2004/0058266 | A1* | 3/2004 | Matsumura et al. | 430/109.2 |
| 2008/0014526 | A1* | 1/2008 | Miura et al. | 430/114 |
| 2008/0124153 | A1* | 5/2008 | Kakishima et al. | 399/341 |
| 2008/0131802 | A1* | 6/2008 | Mizutani et al. | 430/109.4 |
| 2010/0183969 | A1* | 7/2010 | Suzuki et al. | 430/108.2 |
| 2011/0223531 | A1 | 9/2011 | Mizuhata et al. | |

FOREIGN PATENT DOCUMENTS

| | | | |
|---|---|---|---|
| JP | S64-44955 | A | 2/1989 |
| JP | S64-57270 | A | 3/1989 |
| JP | H03-63665 | A | 3/1991 |
| JP | 5097568 | B2 | 12/2012 |
| JP | 5186304 | B2 | 4/2013 |

* cited by examiner

*Primary Examiner* — Clayton E Laballe
*Assistant Examiner* — Jas Sanghera
(74) *Attorney, Agent, or Firm* — Oliff PLC

(57) ABSTRACT

An image forming method includes forming an unfixed toner image on a recording medium using a toner that contains a carboxyl group-containing resin having a carboxyl group and an oxazoline group-containing resin having an oxazoline group, fixing the unfixed toner image to the recording medium to form a fixed toner image, and performing a heat treatment on the fixed toner image at a temperature higher than or equal to a fixing temperature.

12 Claims, 2 Drawing Sheets

IMAGE FORMING METHOD

CROSS-REFERENCE TO RELATED APPLICATIONS

This application is based on and claims priority under 35 USC 119 from Japanese Patent Application No. 2014-164283 filed Aug. 12, 2014.

BACKGROUND

1. Technical Field

The present invention relates to an image forming method.

2. Related Art

In recent years, an image forming method which visualizes image information through an electrostatic charge image using an electrophotographic method or the like has been used in various fields. In the electrophotographic method, a latent image (electrostatic latent image) is formed on an image holding member by a charging process and an exposure process (latent image forming process), an electrostatic latent image is developed using a developer for developing an electrostatic charge image (hereinafter, simply referred to as a "developer" in some cases) containing a toner for developing an electrostatic charge image (hereinafter, simply referred to as a "toner" in some cases) (developing process), and the developed image is visualized through a transfer process and a fixing process. As a developer used for a dry developing system, a two-component developer formed of a toner and a carrier and a single-component developer formed of only a magnetic toner or a non-magnetic toner are exemplified.

A liquid developer used for a wet developing system is a developer obtained by dispersing toner particles in an insulating carrier liquid, and a type of developer in which toner particles containing a thermoplastic resin are dispersed in a volatile carrier liquid and a type of developer in which toner particles containing a thermoplastic resin are dispersed in a hardly volatile carrier liquid are known.

SUMMARY

According to an aspect of the invention, there is provided an image forming method including:

forming an unfixed toner image on a recording medium using a toner that contains a carboxyl group-containing resin having a carboxyl group and an oxazoline group-containing resin having an oxazoline group;

fixing the unfixed toner image to the recording medium to form a fixed toner image; and performing a heat treatment on the fixed toner image at a temperature higher than or equal to a fixing temperature.

BRIEF DESCRIPTION OF THE DRAWINGS

Exemplary embodiments of the present invention will be described in detail based on the following figures, wherein.

DETAILED DESCRIPTION

Figure 1:
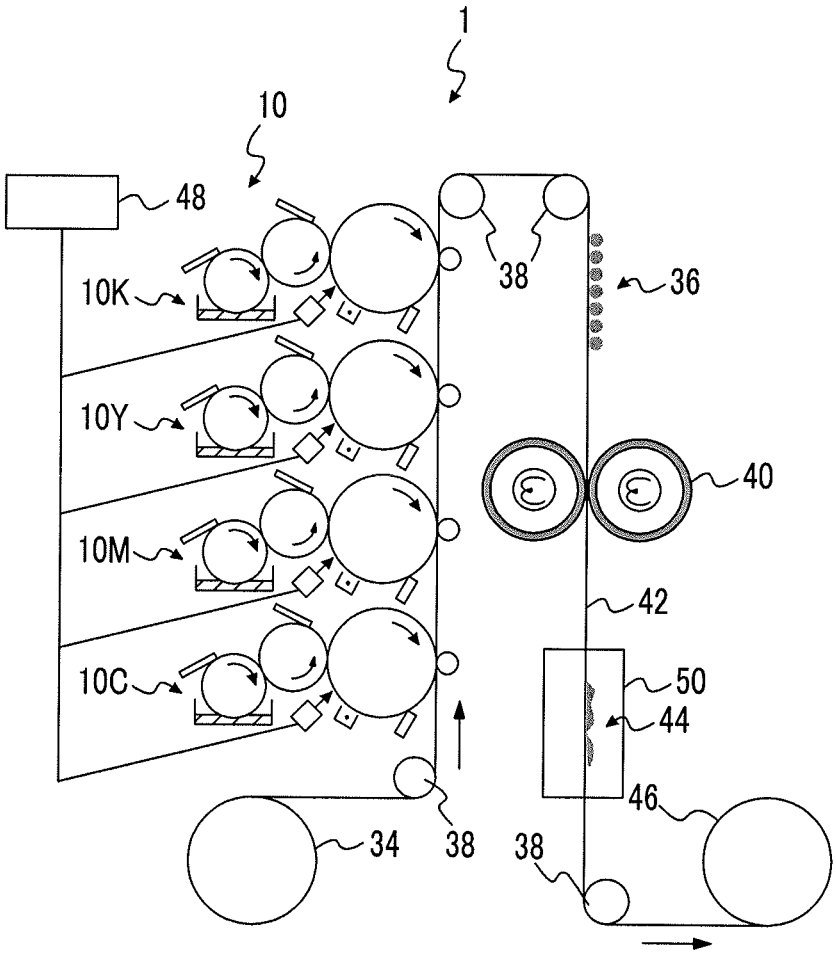
FIG. 1 is a view schematically illustrating an example of an image forming apparatus according to an exemplary embodiment of the present invention.

Hereinafter, exemplary embodiments of the present invention will be described. The present exemplary embodiment is an example of embodying the present invention and the present invention is not limited to the present exemplary embodiment.

Since a toner used for a developer such as a liquid developer in the related art is formed of a thermoplastic resin as a binder resin, storability of an image is low compared to printed matter of offset printing or the like. That is, when toner images or a toner image and a sheet are superimposed each other and then kept at a temperature of higher than or equal to the glass transition temperature (Tg) of the thermoplastic resin, image deterioration, in which apart of the toner image is peeled off, so-called document offset or blocking is generated in some cases.

In order to cope with the above-described problem, a technique of allowing a release agent such as a wax to be contained in a toner is known. However, it is necessary to use a large amount of wax for maintaining image storability and, as a result, image intensity such as resistance to bending characteristics or resistance to scratching characteristics is deteriorated. Particularly, since carrier oil remains in a toner, a liquid developer is inferior to a dry developer in terms of achieving both of a fixing property and image storability, and thus a liquid developer and an image forming method with an excellent fixing property and excellent image storability have been demanded.

Further, for the purpose of improving fixing strength of a toner, a technique of improving a fixing property by introducing a resin and a crosslinking agent having a crosslinking moiety in a binder resin of the toner and crosslinking and curing these by applying a heat treatment thereto during fixation or after fixation has been proposed, and examples of the crosslinking moiety include a carboxyl group, a gylcidyl group, a hydroxyl group, and an amino group, and examples of the corresponding crosslinking agent include block isocyanate, a melamine resin, and an epoxy resin. However, both of a fixing property and image storability may not be sufficiently achieved with a combination of these. That is, a crosslinking reaction proceeds very slowly or very quickly depending on the combination of a crosslinking moiety and a crosslinking agent, and an appropriate catalyst is necessary in the case where the crosslinking reaction proceeds very slowly. When the crosslinking reaction proceeds slowly or an amount of a catalyst is large, the storability of the toner itself is deteriorated or the charging property thereof is adversely affected in some cases. When an amount of a catalyst is small, there is a problem in that document offset occurs.

A method of improving a fixing property and storage stability by UV rays or electron beams using a resin having a photocurable moiety in a binder resin in a toner has been proposed. However, handling of the toner is complicated because the toner is required to be handled in a light shielding state due to a curing catalyst being mixed in the toner. Further, in a case where a color image is output, there is a problem in that UV curing is not sufficiently performed on the bottom layer because a color toner is laminated.

A method of producing a toner including a process of aggregating emulsified particles of a polyester resin having a carboxyl group in an aqueous medium, adding a compound having a functional group capable of reacting with a carboxyl group of an oxazoline group or the like, and chemically bonding the compound to the polyester resin has been proposed. Further, a toner obtained by reacting an oxazoline compound with a carboxylic acid component containing a trivalent or higher polyvalent carboxylic acid component and a polyester resin obtained through polycondensation with an alcohol component; and a toner in which a carboxyl group which is present in a styrene-acryl-modified polyester resin is modified by a compound having an oxazoline group are known. These toners intend to obtain heat resistant storability or a wide fixing temperature width by polymerizing a polyester resin which is a binder resin in the toner.

The present inventors have found that both of image storability and image intensity may be achieved by forming an unfixed toner image on a recording medium using a toner containing a carboxyl group-containing resin having a carboxyl group and an oxazoline group-containing resin having an oxazoline group, fixing the image, and applying a heating treatment thereto. A crosslinking reaction of a carboxyl group and an oxazoline group shown below is caused by the heating treatment after the fixing of the toner and the image storability and the image intensity are improved.

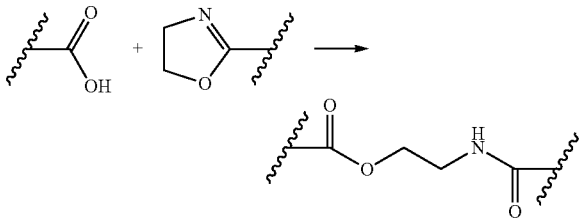

Carboxyl group Oxazoline group Cross-linked structure (amide ester)

For example, heating is performed on a fixed image at a temperature of higher than or equal to the fixing temperature or preferably higher than or equal to the crosslinking temperature of the oxazoline group using a developer such as a liquid developer in which a toner containing a resin having a carboxyl group and a resin having an oxazoline group is dispersed in carrier oil so that a crosslinking reaction occurs, and therefore, the image expresses excellent image storability and image intensity. A catalyst may not be necessary for curing in crosslinking between a carboxyl group and an oxazoline group. Therefore, crosslinking is unlikely to affect fixing or charging of the toner. Further, a catalyst supply system may not be included because a catalyst may not be necessary. A by-product is not likely to be formed by the crosslinking reaction such as block isocyanate and a problem due to a volatile organic compound (VOC) substantially does not occur.

Image Forming Method

An image forming method according to the present exemplary embodiment includes an unfixed toner image forming process of forming an unfixed toner image on a recording medium using a toner containing a carboxyl group-containing resin which has a carboxyl group and an oxazoline group-containing resin which has an oxazoline group; a fixing process of fixing the unfixed toner image on the recording medium to form a fixed toner image; and a heating treatment process of applying a heating treatment to the fixed toner image at a temperature of higher than or equal to the fixing temperature thereof.

The image forming method according to the present exemplary embodiment may include a latent image forming process of forming a latent image (electrostatic latent image) on a surface of an image holding member (hereinafter, also referred to as a "photoreceptor"); a developing process of developing the latent image formed on the surface of the image holding member using a developer such as a liquid developer including a toner which contains a carboxyl group-containing resin having a carboxyl group and an oxazoline group-containing resin having an oxazoline group to form a toner image; a transfer process of transferring the toner image formed on the surface of the image holding member to a recording medium to form an unfixed toner image on the recording medium as an unfixed toner image forming process; a fixing process of fixing the unfixed toner image on the recording medium to form a fixed toner image; and a heating treatment process of applying a heating treatment to the fixed toner image at a temperature of higher than or equal to the fixing temperature thereof.

An image forming apparatus realizing the image forming method according to the present exemplary embodiment includes an image holding member; a charging unit that charges the surface of the image holding member; a latent image forming unit that forms a latent image on the surface of the image holding member; a developing unit that develops the latent image formed on the surface of the image holding member using a developer such as a liquid developer containing the above-described toner to form a toner image; a transfer unit that transfers the toner image formed on the surface of the image holding member onto a recording medium to form an unfixed toner image on the recording medium; a fixing unit that fixes the unfixed toner image to the recording medium to form a fixed toner image; and a heating treatment unit that applies a heating treatment on the fixed toner image at a temperature of higher than or equal to the fixing temperature.

In the image forming apparatus, for example, a portion having the developing unit may have a cartridge structure (process cartridge) that is detachable from the image forming apparatus main body. The process cartridge is not particularly limited as long as a developer such as a liquid developer including the above-described toner is accommodated therein. The process cartridge includes a developing unit that accommodates a developer such as a liquid developer including the above-described toner, develops a latent image formed on an image holding member using a developer such as a liquid developer, to form a toner image and is detachable from an image forming apparatus.

In addition, the image forming apparatus may include a developer cartridge accommodating a developer such as a liquid developer including the above-described toner. The developer cartridge is not particularly limited as long as a developer such as a liquid developer including the above-described toner is accommodated therein. The developer cartridge includes a developing unit that accommodates a developer such as a liquid developer including the above-described toner, develops a latent image formed on an image holding member using a developer such as a liquid developer, to form a toner image and is detachable from the image forming apparatus.

Figure 2:
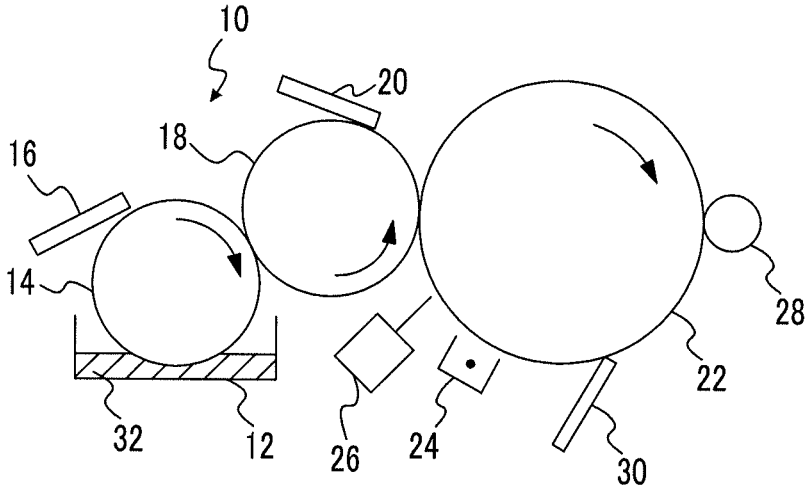
FIG. 2 is a view schematically illustrating a developing device of FIG. 1 by enlarging a portion thereof.

Hereinafter, the image forming apparatus realizing the image forming method according to the present exemplary embodiment will be described with reference to the accompanying drawings using an image forming apparatus which has a liquid developer as an example. An outline of an example of an image forming apparatus having a continuous form for a liquid developer according to the present exemplary embodiment is illustrated in FIG. 1 and an enlarged view of a portion of a developing device 10 is illustrated in FIG. 2, but the present invention is not limited to the configurations of FIGS. 1 and 2. Further, the image forming apparatus realizing the image forming method according to the present exemplary embodiment may use a dry developer.

As illustrated in FIG. 1, an image forming apparatus 1 includes a developing device 10 as a developing unit having a black developing device 10K, a yellow developing device 10Y, a magenta developing device 10M, and a cyan developing device 100. As illustrated in FIG. 2, the image forming apparatus 1 includes a developing device 10, a photoreceptor 22, a charging device 24 as a charging unit, an exposure device 26 as a latent image forming unit, a transfer device 28 as a transfer unit, and a photoreceptor cleaner 30 as a photoreceptor cleaning unit. The developing device 10 includes a developer tank 12, a developer supply roll 14, a developer supply amount restricting unit 16, a developing roll 18, and a developing roll cleaner 20.

An operation of the image forming device 1 will be described with reference to FIGS. 1 and 2. Image forming processes such as image forming, developing, sheet transporting, and fixing are performed by an image forming instruction from a host computer (not illustrated). In FIG. 2, the photoreceptor 22 is charged by the charging device 24 such that the surface thereof has a predetermined charging bias amount (charging process) and an electrostatic latent image is formed on the surface of the photoreceptor 22 by light beams or the like from the exposure device 26 based on information in which an image signal sent from the host computer or the like is treated by an image signal arithmetic unit 48 illustrated in FIG. 1 (latent image forming process).

The liquid developer 32, obtained by dispersing toner particles in a carrier liquid, whose predetermined amount is maintained by a developer circulating unit (not illustrated) is transported from the developer tank 12 to the developing roll 18 by the developer supply roll 14. The developer supply roll 14 has a system of charging the surface and adhering a developer thereto using the electrostatic force and a system of providing a groove or a recess on the roll and transporting a liquid by pumping the liquid, and the transporting amount is restricted to be a predetermined amount by the developer supply amount restricting unit 16. The developer on the developing roll 18 is transferred to the photoreceptor 22 based on the electrostatic latent image (developing process) and unnecessary developer returns to the developer tank 12 by the developing roll cleaner 20 and the developer circulating unit (not illustrated).

The developer formed on the surface of the photoreceptor is transferred to a sheet 42 as a recording medium illustrated in FIG. 1 by the transfer device 28 (transfer process). The sheet 42 is a sheet having a continuous form and the sheet 42 supplied from a roll paper supply unit 34 is stretched by a stretch roll 38 and sent to a winding unit 46 by a sheet driving unit (not illustrated). Further, the winding unit 46 is not necessarily required and a post-treatment process such as cutting or binding may be provided. The transfer device 28 sequentially transfers respective developers such as cyan, magenta, yellow, and black to the sheet 42 by the electrostatic force or the pressure. In the transferring device 28 of respective colors, there is a difference in the set potential so that transferring a developer on the upstream side to a unit having another color when colors are overlapped is prevented. Most of the developer on the photoreceptor 22 is transferred to the sheet 42, but a small amount of developer remaining thereon is removed by the photoreceptor cleaner 30 (photoreceptor cleaning process).

An unfixed toner image 36 formed on the sheet 42 is fixed by the fixing device 40 and then made into a fixed toner image 44 (fixing process). The fixing device 40 includes a fixing roll pair in which an elastic rubber or the like is formed on a metal roll or the like and a release layer for releasing is formed on the surface of the elastic rubber or the like, and which nips the sheet 42 by a pressing mechanism (not illustrated) so as to obtain a predetermined pressure and a nip width.

The fixed toner image 44 is subjected to a heating treatment at a temperature of higher than or equal to the fixing temperature in the fixing process in a heating device 50 as a heating treatment unit (heating treatment process). A crosslinking reaction between a carboxyl group of a resin having a carboxyl group contained in a toner in the fixed image and an oxazoline group of a resin having an oxazoline group occurs by the heating treatment and the image expresses excellent image storability and image intensity.

The heating device 50 is not particularly limited as long as the fixed toner image 44 is heated by the device, and a system of providing energy in a non-contact manner without direct contact to a toner image such as a system of applying far-infrared light or laser light; a system of blowing hot air or steam; or a system of bringing the rear surface of the sheet into contact with a heating member may be employed in addition to a system of heating the toner image using a heating device such as an oven or the like. Further, a combination with other fixing units or plural fixing roll pairs may be provided.

It is preferable that the heating temperature in the heating device 50 be a temperature of higher than or equal to the fixing temperature and be appropriately set based on the crosslinking temperature or the like of an oxazoline group-containing resin to be used. For example, the heating temperature is in the range of the crosslinking temperature +10° C. to the crosslinking temperature +100° C. of an oxazoline group-containing resin.

The image forming method according to the present exemplary embodiment is used as an image forming method using a developer, for example, a liquid developer such as electrophotography, electrostatic recording, electrostatic printing, or inkjet printing.

Toner

A toner used in the image forming method according to the present exemplary embodiment contains a binder resin and may contain other components such as a colorant if necessary. The toner used in the image forming method according to the present exemplary embodiment contains a carboxyl group-containing resin having a carboxyl group and an oxazoline group-containing resin having an oxazoline group as a binder resin.

Carboxyl Group-Containing Resin

The carboxyl group-containing resin is not particularly limited as long as a resin contains a carboxyl group on the terminal or the side chain thereof. Examples of the carboxyl group-containing resin include a polyester resin such as a crystalline polyester resin or an amorphous polyester resin; a styrene-acrylic resin; and an acid-modified polyethylene resin, and it is preferable to contain a crystalline polyester resin and an amorphous polyester resin in terms of easily achieving both of image storability and image intensity.

The weight average molecular weight (Mw) of a carboxyl group-containing resin is preferably in the range of 10000 to 1000000. When the weight average molecular weight (Mw) of a carboxyl group-containing resin is less than 10000, the fixing strength is deteriorated in some cases. Further, when the weight average molecular weight (Mw) of a carboxyl group-containing resin is greater than 1000000, fixing failure occurs in some cases.

The acid value of a carboxyl group-containing resin is preferably in the range of 5 mg KOH/g to 50 mg KOH/g. When the acid value of a carboxyl group-containing resin is less than 5 mg KOH/g, curing failure occurs in some cases. Further, when the acid value of a carboxyl group-containing resin is greater than 50 mg KOH/g, charging failure occurs in some cases.

Crystalline Polyester Resin

It is preferable that the toner in the present exemplary embodiment contain a polyester resin as a binder resin and more preferable that the toner contain a crystalline polyester resin and an amorphous polyester resin. Here, the term "crystalline" of the "crystalline resin" indicates that a resin has a clear endothermic peak which is not a change in stepwise endothermic amount in differential scanning calorimetry (DSC) of the resin. Specifically, in differential scanning calorimetry (DSC) using a differential scanning calorimeter (trade name: DSC-60 type, manufactured by Shimadzu Corporation) including an automatic tangent processing system, it is assumed that the resin has a "clear" endothermic peak in a case where a temperature from an offset point to a peak top of the endothermic peak when the temperature is increased at a temperature rising rate of 10° C./min is within 10° C. A point of a flat portion on a base line in the DSC curve and a point of a flat portion of a falling portion from the base line are designated and an intersection of a tangent of the flat portion between both points is determined by the automatic tangent processing system as the "offset point". On the other hand, a resin in which not a clear endothermic peak but a change in stepwise endothermic amount is recognized means an "amorphous resin" and this indicates that the resin is a solid at room temperature and is thermally plasticized at a temperature of higher than or equal to the glass transition temperature. In addition, the "amorphous resin" does not show an endothermic peak corresponding to a crystalline melting point other than a stepwise endothermic point corresponding to the glass transition in the differential scanning calorimetry (DSC).

As a polymerizable monomer component constituting a crystalline polyester resin, a polymerizable monomer having a linear aliphatic component is more preferable than a polymerizable monomer having an aromatic component because a crystal structure is easily formed. In order not to damage crystallinity, it is preferable that polymerizable monomer-derived components to be formed be contained by an amount of 30% by mole or more respectively for each kind thereof in a polymer. The crystalline polyester resin is formed of two or more kinds of polymerizable monomers, but it is preferable that each constituent polymerizable monomer have the same structure described above.

The melting temperature of the crystalline polyester resin is preferably in the range of 50° C. to 100° C., more preferably in the range of 55° C. to 90° C., and still more preferably in the range of 60° C. to 85° C. When the melting temperature thereof is lower than 50° C., blocking occurs in the stored toner in some cases, which means that the toner storability or the storability of the fixed image is deteriorated. In addition, in a case where the melting temperature exceeds 100° C., a low temperature fixing property may not be sufficiently obtained. Moreover, the melting temperature of the crystalline polyester resin is determined as the peak temperature of the endothermic peak obtained by the differential scanning calorimetry (DSC).

The "crystalline polyester resin" in the present exemplary embodiment means a polymer (copolymer) obtained by polymerizing components constituting polyester and other components together in addition to a polymer whose constituent component has a 100% polyester structure. However, in the case of the polymer (copolymer) obtained by polymerizing components constituting polyester and other components together, the content of other constituent components other than polyester constituting the polymer (copolymer) is 50% by weight or less.

The crystalline polyester resin is synthesized by, for example, a polyvalent carboxylic acid component and a polyol component. Further, in the present exemplary embodiment, a commercially available product may be used as the crystalline polyester resin or a synthesized resin may be used.

Examples of the polyvalent carboxylic acid component include aliphatic dicarboxylic acid such as oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, or 1,18-octadecane dicarboxylic acid; aromatic dicarboxylic acid, for example, dibasic acid such as phthalic acid, isophthalic acid, terephthalic acid, naphthalene-2,6-dicarboxylic acid, malonic acid, or mesaconic acid; an anhydride thereof; and lower alkyl ester thereof, but the examples are not limited thereto.

Examples of trivalent or higher carboxylic acid include 1,2,4-benzene tricarboxylic acid, 1,2,5-benzene tricarboxylic acid, 1,2,4-naphthalene tricarboxylic acid, an anhydride thereof, and lower alkyl ester thereof. There may be used alone or in combination of two or more kinds thereof.

In addition, the polyvalent carboxylic acid components may include a dicarboxylic acid component having a sulfonic acid group in addition to the aliphatic dicarboxylic acid or aromatic dicarboxylic acid. Further, the polyvalent carboxylic acid components may include a dicarboxylic acid component having a double bond in addition to the aliphatic dicarboxylic acid or aromatic dicarboxylic acid.

As the polyol component, an aliphatic diol is preferable and a linear aliphatic diol whose main chain portion has 7 to 20 carbon atoms is more preferable. When the aliphatic diol is branched, the crystallinity of a polyester resin is deteriorated and the melting temperature thereof is decreased in some cases. Further, when the carbon atoms of the main chain portion is less than 7, the melting temperature is increased and the low temperature fixing becomes difficult in a case where the aliphatic diol is polycondensed with aromatic dicarboxylic acid. Meanwhile, the number of carbon atoms of the main chain portion exceeds 20, practically, materials tend to be difficult to obtain. The number of carbon atoms of the main chain portion is more preferably 14 or less.

Specific examples of the aliphatic diol preferably used for synthesis of crystalline polyester include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol, but the examples are not limited thereto. From a viewpoint of easy availability, 1,8-octanediol, 1,9-nonanediol, and 1,10-decanediol are preferable.

Examples of trivalent or higher alcohol include glycerin, trimethylol ethane, trimethylol propane, and pentaerythritol. These may be used alone or in combination of two or more kinds thereof.

Among polyol components, the content of the aliphatic diol is preferably 80% by mole or more and more preferably 90% by mole or more. When the content of the aliphatic diol is less than 80% by mole, since the crystallinity of a polyester resin is deteriorated and the melting temperature thereof is decreased, toner blocking resistance, image storability, and the low temperature fixing property are deteriorated in some cases.

Moreover, for the purpose of preparing the acid value or the hydroxyl value according to the necessity, polyvalent carboxylic acid or polyol may be added at the final stage of synthesis. Examples of the polyvalent carboxylic acid include aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acids such as cyclohexane dicarboxylic acid.

The crystalline polyester resin is produced at a polymerization temperature of 180° C. to 230° C., and a reaction is performed by reducing the pressure in a reaction system according to the necessity and removing water or alcohol generated during condensation. In a case where a polymerizable monomer is not dissolved or compatible at the reaction temperature, the polymerizable monomer may be dissolved by adding a solvent having a high boiling point as a solubilizing agent. The polycondensation reaction may be performed while the solubilizing agent is distilled. Ina case where a polymerizable monomer with poor compatibility is present in a copolymerization reaction, the polymerizable monomer with poor compatibility and acids or alcohol to be polycondensed with the polymerizable monomer is condensed in advance, and then polycondensation with the main component may be performed.

Examples of the catalyst used when the polyester resin is produced include an alkali metal compound such as sodium or lithium; an alkaline-earth metal compound such as magnesium or calcium; a metal compound such as zinc, manganese, antimony, titanium, tin, zirconium, or germanium; a phosphorous acid compound; a phosphoric acid compound; and an amine compound.

The acid value (the number of mgs of KOH required to neutralize 1 g of a resin) of the crystalline polyester resin is preferably in the range of 3.0 mg KOH/g to 30.0 mg KOH/g, more preferably in the range of 6.0 mg KOH/g to 25.0 mg KOH/g, and still more preferably in the range of 8.0 mg KOH/g to 20.0 mg KOH/g.

When the acid value is lower than 3.0 mg KOH/g, since the dispersibility in water is deteriorated, preparing emulsified particles using a wet method becomes difficult in some cases. Moreover, since the stability as the emulsified particles during aggregation is exceedingly deteriorated, efficient preparing of a toner becomes difficult in some cases. Meanwhile, when the acid value exceeds 30.0 mg KOH/g, since the hygroscopicity as the toner is increased, the toner is easily affected by the environment in some cases.

The weight average molecular weight (Mw) of the crystalline polyester resin is preferably in the range of 6000 to 35000. When the weight average molecular weight (Mw) is less than 6000, the toner is infiltrated into the surface of a recording medium such as paper during fixation so that fixing unevenness occurs or intensity with respect to the resistance to bending characteristics of a fixed image is deteriorated in some cases. Further, when the weight average molecular weight (Mw) exceeds 35000, the viscosity at the time of melting becomes extremely increased so that the temperature for reaching viscosity appropriate for fixation becomes increased, and thus, a low temperature fixing property is deteriorated in some cases.

The weight average molecular weight is measured by a gel permeation chromatography (GPC). Measurement of the molecular weight using GPC is performed in a THF solvent using GPC.HLC-8120 (manufactured by Tosoh Corporation) as a measuring device and column.TSKgel SuperHM-M (15 cm) (manufactured by Tosoh Corporation). The weight average molecular weight is calculated using a molecular weight calibration curve created by a monodisperse polystyrene standard sample from the measurement results.

The content of the crystalline polyester resin in the toner is preferably in the range of 3% by weight to 40% by weight, more preferably in the range of 4% by weight to 35% by weight, and still more preferably in the range of 5% by weight to 30% by weight. When the content of the crystalline polyester resin is less than 3% by weight, the low temperature fixing property may not be sufficiently obtained. Meanwhile, the content thereof exceeds 40% by weight, the toner intensity or fixing image intensity may not be sufficiently obtained and the charging property may be adversely affected.

It is preferable that the crystalline resin containing the above-described crystalline polyester resin contain a crystalline polyester resin (hereinafter, also referred to a "crystalline aliphatic polyester resin") synthesized using an aliphatic polymerizable monomer as a main component (50% by weight or more). Further, in this case, the component ratio of the aliphatic polymerizable monomer constituting the crystalline aliphatic polyester resin is preferably 60% by mole or more and more preferably 90% by mole or more. Moreover, as the aliphatic polymerizable monomer, aliphatic diols described above or dicarboxylic acids are preferably used.

Amorphous Polyester Resin

As an amorphous polyester resin, a known polyester resin may be used. The amorphous polyester resin is synthesized from a polyvalent carboxylic acid component and a polyol component. Further, a commercially available product or a synthesized product may be used as the amorphous polyester resin. In addition, the amorphous polyester resin may be formed of one kind of amorphous polyester resin or a mixture of two or more kinds of polyester resins.

Polyvalent carboxylic acid and polyol used for the amorphous polyester resin are not particularly limited, and divalent or trivalent or higher carboxylic acid in the related art and divalent or trivalent or higher alcohol which are monomer components described in "Polymer Data Handbook: Fundamentals" (edited by Society of Polymer, published by Baifukan Co., Ltd.) can be exemplified.

Specific examples of these polymerizable monomer components include, as divalent carboxylic acid, dibasic acids such as succinic acid, alkyl succinic acid, alkenyl succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid, or masaconic acid; anhydrides of these; lower alkyl ester of these; and aliphatic unsaturated dicarboxylic acid such as maleic acid, fumaric acid, itaconic acid, or citraconic acid. Among these compounds, it is preferable that 30% by mole or more of terephthalic acid be contained in acid components in terms of the balance between the glass transition temperature of the polyester resin and the flexibility of molecules.

Examples of trivalent or higher carboxylic acid include 1,2,4-benzene tricarboxylic acid, 1,2,5-benzene tricarboxylic acid, 1,2,4-naphthalene tricarboxylic acid, anhydrides of theses, and lower alkyl ester of these. These may be used alone or in combination of two or more kinds thereof.

Examples of the polyol include, as divalent alcohol, a bisphenol derivative such as hydrogenated bisphenol A, ethylene oxide of bisphenol A, or a propylene oxide adduct; cyclic aliphatic alcohol such as 1,4-cyclohexanediol or 1,4-cyclohexane dimethanol; a linear diol such as ethylene glycol, diethylene glycol, propylene glycol, dipropylene glycol, 1,4-butanediol, 1,5-pentanediol, or 1,6-hexanediol; and a branched diol such as 1,2-propanediol, 1,3-butanediol, neopentyl glycol, or 2,2-diethyl-1,3-propanediol, and ethyl oxide of bisphenol A or a propylene oxide adduct is preferably used from a viewpoint of the charging property and the intensity.

Further, examples of trivalent or higher alcohol include glycerin, trimethylol ethane, trimethylol propane, and pentaerythritol, and the amount of trivalent or higher crosslinkable monomers is preferably 10% by mole or less with respect to the total amount of monomers from a viewpoint of the low temperature fixing property or image gloss. These may be used alone or in combination of two or more kinds thereof. In addition, for the purpose of preparing the acid value or the hydroxyl value according to the necessity, a monovalent acid such as acetic acid or benzoic acid and monovalent alcohol such as cyclohexanol or benzyl alcohol may be used.

Among these, in order to improve compatibility with a crystalline polyester resin, it is preferable that monomer components containing monomers, having a long-chain alkyl side chain (the number of carbon atoms of the side chain: 4 or more) such as 1,2-hexanediol, alkyl succinic acid, alkenyl succinic acid, or anhydrides of these, in the range of 2% by mole to 30% by mole be used. Among these, it is preferable to contain alkyl succinic acid, alkenyl succinic acid, and anhydrides of these, with high hydrophobicity.

As the amorphous polyester resin which is preferably used, a resin obtained through polycondensation between polyvalent carboxylic acids and polyols can be exemplified. Examples of the polyvalent carboxylic acid are the same as those of the above-described crystalline polyester resin.

Examples of the polyol in the amorphous polyester resin are the same as those of the above-described crystalline polyester resin.

The glass transition temperature (Tg) of the amorphous polyester resin is preferably in the range of 50° C. to 80° C. When Tg is lower than 50° C., problems in the storability of a toner or the storability of a fixed image are caused in some cases. When Tg is higher than 80° C., an image is not fixed because of the lower temperature compared with that in the related art.

In addition, the amorphous polyester resin is produced in conformity with the case of the crystalline polyester resin.

The softening temperature of a binder resin (flow tester ½ dropping temperature) is preferably in the range of 90° C. to 140° C., more preferably in the range of 100° C. to 135° C., and still more preferably in the range of 100° C. to 120° C. from a viewpoint of improving the fixing property of an image.

In addition, the binder resin is preferably soluble in tetrahydrofuran. Here, "soluble in tetrahydrofuran" means that the binder resin is dissolved in tetrahydrofuran when 1 g of the binder resin is added to 10 mL of tetrahydrofuran and dispersed in the tetrahydrofuran using an ultrasonic disperser at a temperature of 25° C. for 5 minutes.

The toner according to the present exemplary embodiment may contain a resin other than a polyester resin or may contain a resin other than a polyester resin in addition to a polyester resin. Examples of the resin other than a polyester resin, which are not particularly limited, include styrenes such as styrene, parachlorostyrene, and α-methyl styrene; an acrylic monomer such as methyl acrylate, ethyl acrylate, acrylic acid n-propyl, butyl acrylate, lauryl acrylate, or 2-ethylhexyl acrylate; a methacrylic monomer such as methyl methacrylate, ethyl methacrylate, methacrylic acid n-propyl, lauryl methacrylate, or 2-ethylhexyl methacrylate; an ethylenically unsaturated acid monomer such as acrylic acid, methacrylic acid, or sodium styrene solfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; a homopolymer of olefins monomers such as ethylene, propylene, and butadiene; a copolymer obtained by combining two or more kinds of these monomers; a mixture of these; a non-vinyl condensation resin such as an epoxy resin, a polyester resin, a polyurethane resin, a polyamide resin, a cellulose resin, or a polyether resin; a mixture of these and the above-described vinyl resin; and a graft polymer obtained by polymerizing vinyl monomers in the coexistence of these. These resins may be used alone or in combination of two or more kinds thereof.

Oxazoline Group-Containing Resin

The oxazoline group-containing resin is not particularly limited as long as a resin contains an oxazoline group in the side chain thereof. Examples of the oxazoline group-containing resin include a styrene-acrylic resin, a styrene-methacrylic resin, a polyester resin, and a polyurethane resin containing an oxazoline group in the side chain thereof, and a styrene-acrylic resin is preferable in terms of manufacturability or the like.

The weight average molecular weight (Mw) of the oxazoline group-containing resin is preferably in the range of 5000 to 100000. When the weight average molecular weight (Mw) of the oxazoline group-containing resin is less than 5000, the fixing property is deteriorated in some cases. Further, when the weight average molecular weight (Mw) of the oxazoline group-containing resin exceeds 100000, crosslinking becomes insufficient in some cases.

The content of the binder resin containing a carboxyl group-containing resin and an oxazoline group-containing resin is in the range of 80% by weight to 95% by weight with respect to the entirety of the toner.

The content of the oxazoline group-containing resin in the binder resin may be set such that the molar amount of the oxazoline group in the oxazoline group-containing resin is in the range of about an equimolar amount to 10 molar times with respect to the carboxyl group in the carboxyl group-containing resin.

The crosslinking temperature of the carboxyl group-containing resin and the oxazoline group-containing resin may be a temperature of higher than or equal to the fixing temperature thereof and may be in the range of the fixing temperature +10° C. to the temperature +100° C.

Other Components

The toner may contain a colorant and other additives such as a wax, a charge-controlling agent, silica powder, and metal oxides if necessary in addition to a binder resin. These additives may be internally added by kneading a binder resin or externally added by applying a mixing treatment after a toner is obtained as particles.

As the colorant used in the present exemplary embodiment, a known pigment or dye may be used. Specifically, respective pigments of yellow, magenta, cyan, and black described below are preferably used.

As a pigment of yellow, a compound represented by a condensed azo compound, an isoindolinone compound, an anthraquinone compound, an azo metal complex compound, a methine compound, or an allyl amide compound is used. Specific examples of the pigments to be preferably used include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 168, C.I. Pigment Yellow 174, C.I. Pigment Yellow 176, C.I. Pigment Yellow 180, C.I. Pigment Yellow 181, C.I. Pigment Yellow 185, and C.I. Pigment Yellow 191. Among these, C.I. Pigment Yellow 151, C.I. Pigment Yellow 180, and C.I. Pigment Yellow 185 are excellent in terms of color reproducibility and not containing halogen.

As a pigment of magenta, a condensed azo compound, a diketopyrrolopyrrole compound, anthraquinone, a quinacridone compound, a basic dye lake compound, a naphthol compound, a benzimidazolon compound, a thioindigo compound, or a perylene compound is used. Specific examples of the pigments to be preferably used include C.I. Pigment Red 2, C.I. Pigment Red 3, C.I. Pigment Red 5, C.I. Pigment Red 6, C.I. Pigment Red 7, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254. Among these, C.I. Pigment Red 122 of a quinacridone pigment is excellent in terms of color reproducibility and not containing halogen.

As a pigment of cyan, a copper phthalocyanine compound, a derivative thereof, an anthraquinone compound, or a basic dye lake compound is preferably used. Specific examples the pigments to be preferably used include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66. Among these, C.I. Pigment Blue 15:3 is excellent in terms of color reproducibility and not containing halogen.

As a pigment of black, carbon black, aniline black, acetylene black, or iron black is preferably used.

The content of the colorant is preferably in the range of 5% by weight to 20% by weight with respect to the entirety of toner particles.

Examples of the wax, which are not particularly limited, include vegetable waxes such as a carnauba wax, a sugar wax, and a wood wax; animal waxes such as a honey wax, an insect wax, a whale wax, and a wool wax; and synthetic hydrocarbon waxes such as a Fischer-Tropsch wax (FT wax) having ester in the side chain thereof, a polyethylene wax, and a polypropylene wax. Among these, an FT wax or a polyethylene wax is preferable in terms of dispersibility. The wax may be used alone or in combination of two or more kinds thereof.

The content of the wax is in the range of 0.1% by weight to 10% by weight with respect to the entirety of toner particles.

The charge-controlling agent is not particularly limited and a known charge-controlling agent in the related art may be used. Examples thereof include a positively chargeable change control agent such as a nigrosine dye, a fatty acid-modified nigrosine dye, a carboxyl group-containing fatty acid-modified nigrosine dye, quaternary ammonium salts, an amine compound, an amide compound, an imide compound, or an organic metal compound; and a negatively chargeable charge-controlling agent such as a metal complex of oxycarboxylic acid, a metal complex of an azo compound, a metal complex dye, or a salicylic acid derivative. The charge-controlling agent may be used alone or in combination of two or more kinds thereof.

Examples of the metal oxide, which are not particularly limited, include titanium oxide, aluminum oxide, magnesium oxide, zinc oxide, strontium titanate, barium titanate, magnesium titanate, and calcium titanate. The metal oxide may be used alone or in combination of two or more kinds thereof.

Polyamine Compound

It is preferable that the toner used in the image forming method according to the present exemplary embodiment be subjected to a surface treatment with a polyamine compound. The hot offset is improved by means of using the toner to which the surface treatment is applied by the polyamine compound.

Examples of the polyamine compound include polyalkylene imines, polyallyl amines, and polydiallyl amines. Among these, polyalkylene imines and polyallyl amines are preferable in term of the cost and safety.

As the polyalkylene imines, polyethylene imine and the like can be exemplified.

As the polyallyl amines, polyallyl amines represented by the following formula (I) can be exemplified.

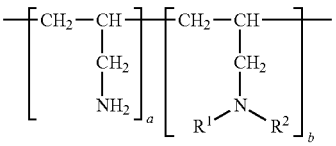

In the formula (I), $R^1$ and $R^2$ each independently represent a hydrogen atom or an aliphatic hydrocarbon group having 1 to 20 carbon atoms; and a and b each independently represent an integer of 100 to 1000.

$R^1$ and $R^2$ each independently represent a hydrogen atom or an aliphatic hydrocarbon group having 1 to 20 carbon atoms and preferably an aliphatic hydrocarbon group having 1 to 20 carbon atoms. Examples of the aliphatic hydrocarbon group having 1 to 20 carbon atoms include a methyl group, an ethyl group, a linear or branched propyl group, a butyl group, a pentyl group, a hexyl group, and an octyl group. Among these, a methyl group is preferable.

a and b each independently represent an integer of 1 to 10000 and preferably an integer of 5 to 1000.

The amount of the polyamine compound with respect to the toner is preferably in the range of 0.01 parts by weight to 100 parts by weight with respect to 100 parts by weight of the toner and more preferably in the range of 0.1 parts by weight to 10 parts by weight. When the amount of a polyamine compound with respect to the toner is less than 0.01 parts by weight with respect to 100 parts by weight of the toner, the charging property is deteriorated in some cases. Meanwhile, when the amount thereof exceeds 100 parts by weight, the conductivity of the developer is extremely high so that the charging property is deteriorated in some cases.

The weight average molecular weight of the polyamine compound is preferably in the range of 100 to 1,000,000 and more preferably in the range of 1,000 to 100,000. When the weight average molecular weight of the polyamine compound is less than 100, the adsorptivity to the surface of the toner is deteriorated and thus target charging performance may not be obtained. Meanwhile, when the weight average molecular weight thereof exceeds 1,000,000, adhesion between toner particles is generated in some cases.

Method of Producing Toner

The toner used for the image forming method according to the present exemplary embodiment may be produced by a method of producing a known pulverized toner in the related art, a liquid emulsified drying toner, a pulverized toner from in liquid precipitation, or a so-called chemical toner accompanied by aggregation and coalescence of emulsified particles. In a case where the toner is used as a liquid developer, the obtained toner described above according to the necessity is dispersed in carrier oil, and the toner particle diameter may be reduced through pulverization using a pulverizing machine such as a ball mill or an attritor.

For example, a binder resin, a colorant if necessary, and other additives are put into a mixing device such as a Henschel mixer, the mixture is molten kneaded using a twin axis extruder or the like, the temperature of the mixture is cooled using a drum flaker, the mixture is coarsely ground using a pulverizer such as a hammer mill and further minutely pulverized using a pulverizer such as a jet mill, and classification is performed using an air classifier, thereby obtaining a pulverized toner.

Further, a binder resin, a colorant if necessary, and other additives are dissolved in a solvent such as ethyl acetate, the solvent is emulsified and suspended in water to which a dispersion stabilizer such as calcium carbonate is added, and particles obtained by removing the dispersion stabilizer are filtered and dried, thereby obtaining a liquid emulsion drying toner.

A binder resin, a colorant if necessary, and other additives are dissolved in a solvent such as THF, toluene, or DMF, the solution is added dropwise to a poor solvent such as alcohol to be deposited and precipitated, and the precipitate is filtrated, dried, pulverized, and classified such as the above-described pulverized toner, and then a toner may be obtained.

Further, polymerizable monomers forming a binder resin, a colorant, a polymerization initiator (for example, benzoyl peroxide, lauroyl peroxide, isopropyl peroxycarbonate, cumene hydroperoxide, 2,4-dichlorobenzoylperoxide, or methyl ethyl ketone peroxide), and a composition containing other additives are added to a water phase to be stirred and granulated, and the granulated particles are subjected to a polymerization reaction, filtered, and dried, and then a polymerized toner may be obtained.

A method of performing phase inversion emulsification on a toner constituent material, which is dissolved in a solvent, in a poor solvent, aggregating and granulating the emulsion using a coagulant or salts, and removing the solvent; and a method of mixing each emulsion of toner constituent materials to each other and aggregating mixed emulsions using a coagulant or salts to obtain particles can be exemplified.

In addition, the mixing ratio of respective materials (a binder resin, a colorant, a wax, and other additives) at the time of obtaining a toner is not particularly limited and may be appropriately set using a known technique in the related art. When a liquid developer is used, the obtained toner may be made into toner particles for a liquid developer by being finely pulverized in carrier oil using a known pulverizing device such as a ball mill, a beads mill, or a high-pressure wet micronizing device.

Characteristics of Toner

A volume average particle diameter D50v of the toner used for the image forming method according to the present exemplary embodiment is preferably in the range of 0.5 μm to 5.0 μm. When the volume average particle diameter D50v is within the above-described range, adhesion strength is high and the developing property is improved. Further, the resolution of an image is improved. The volume average particle diameter D50v is preferably in the range of 0.8 μm to 4.0 μm and more preferably in the range of 1.0 μm to 3.0 μm.

The volume average particle diameter D50v of the toner, the number average particle size distribution index (GSDp), and the volume average particle size distribution index (GSDv) are measured using a laser diffraction/scattering type particle size distribution measuring device, for example, LA-920 (manufactured by Horiba, Ltd.). Cumulative distributions of the volume and the number are drawn from the small diameter side with respect to the particle size range (channel) divided based on the measured particle size distribution, and the particle diameter corresponding to 16% cumulation is defined as a volume particle diameter D16v and a number particle diameter D16p, the particle diameter corresponding to 50% cumulation is defined as a volume particle diameter D50v and a number particle diameter D50p, and the particle diameter corresponding to 84% cumulation is defined as a volume particle diameter D84v and a number particle diameter D84p. Using these definitions, the volume average particle size distribution index (GSDv) is calculated as $(D84v/D16v)^{1/2}$ and the number average particle size distribution index (GSDp) is calculated as $(D84p/D16p)^{1/2}$.

Liquid Developer

The liquid developer used in the present exemplary embodiment contains the toner and a carrier liquid, and it is preferable that the liquid developer contain a carrier liquid containing silicone oil as a main component and the toner.

Carrier Liquid

The carrier liquid is an insulating liquid for dispersing toner particles and an insulting liquid containing silicone oil as a main component is preferable, but the carrier liquid is not particularly limited. Silicone oil may be used alone or a mixed liquid with other insulating liquids may be used. Examples of the silicone oil include KF96 (manufactured by Shin-Etsu Chemical Co., Ltd.), SH200, SH344 (both manufactured by Dow Corning Toray Co., Ltd.), and TSF451 (manufactured by Toshiba Silicone Co., Ltd.). Further, examples of the liquids which may be mixed together, which are not particularly limited, include aliphatic hydrocarbon solvents such as paraffin oil (as commercially available products, Moresco White MT-30P, Moresco White P40, and Moresco White P70, manufactured by Matsumura Oil Company, and Isopar L and Isopar M manufactured by Exxon Chemical Co., Ltd.); hydrocarbon solvents such as naphthenic oil (as commercially available products, Exxsol D80, Exxsol D110, and Exxsol D130 manufactured by Exxon Chemical Co., Ltd., and Naphtesol L, Naphtesol M, Naphtesol H, New Naphtesol 160, New Naphtesol 200, New Naphtesol 220, and New Naphtesol Ms-20P manufactured by Nippon Petrochemicals Co.). Among these, an aromatic compound such as toluene may be contained. Further, "containing silicone oil as a main component" means that the carrier liquid contains 50% by weight or more of silicone oil.

The volume resistivity of the carrier liquid is, for example, in the range of $1.0\times10^{10}$ Ω·cm to $1.0\times10^{14}$ Ω·cm and may be in the range of $1.0\times10^{10}$ Ω·cm to $1.0\times10^{13}$ Ω·cm.

The carrier liquid may contain various auxiliary materials such as a dispersant, an emulsifier, a surfactant, a stabilizer, a wetting agent, a thickener, a foaming agent, an antifoaming agent, a coagulant, a gelling agent, an antisettling agent, a charge-controlling agent, an antistatic agent, an anti-aging agent, a softening agent, a plasticizer, a filler, an odorant, an anti-blocking agent, and a release agent.

The liquid developer according to the present exemplary embodiment is applied to the image forming method using a liquid developer such as electrophotography, electrostatic recording, electrostatic printing, or inkjet printing.

Method of Producing Liquid Developer

The liquid developer according to the present exemplary embodiment may be obtained by mixing the toner and the carrier liquid using a disperser such as a ball mill, a sand mill, an attritor, or a beads mill, pulverizing the mixture, and dispersing the toner in the carrier liquid. Further, dispersion of the toner in the carrier liquid is not limited to a disperser, the toner may be dispersed by rotating a special stirring blade at a high speed, or using shearing force of a rotor-stator known as a homogenizer, or dispersed using an ultrasonic wave.

The concentration of the toner in the carrier liquid is preferably in the range of 0.5% by weight to 40% by weight and more preferably in the range of 1% by weight to 30% by weight from a viewpoint that the viscosity of the developer is appropriately controlled and the developing liquid in a developing device is smoothly circulated.

Next, the obtained developing liquid is filtered using a filter such as a film filter having a pore diameter of approximately 100 μm and dust and coarse particles may be removed.

EXAMPLES

Hereinafter, the present invention will be specifically described with reference to Examples and Comparative Examples, but the present invention is not limited to the following examples.

Synthesis of Amorphous Polyester Resin (1)

80 parts by mole of polyoxypropylene(2,2)-2,2-bis(4-hydroxyphenyl)propane, 20 parts by mole of polyoxyethylene (2,2)-2,2-bis(4-hydroxyphenyl)propane, 50 parts by mole of terephthlaic acid, 25 parts by mole of fumaric acid, and 25 parts by mole of n-dodecenylsuccinic acid as raw materials and dibutyl tin oxide as a catalyst are put into a heated and dried two-necked flask, nitrogen gas is introduced into the container to be maintained in an inert environment, the temperature therein is increased, a co-polycondensation reaction is applied thereto in the temperature range of 150° C. to 230° C. for about 12 hours, and the pressure is gradually reduced in the temperature range of 210° C. to 250° C., and then an amorphous polyester resin (1) is synthesized. The weight average molecular weight (Mw) of the obtained amorphous polyester resin (1) is 17,900. Further, the acid value of the amorphous polyester resin (1) is 14.6 mg KOH/g. Further, the melting point of the amorphous polyester resin (1) is obtained through measurement using a differential scanning calorimeter (DSC) and analysis according to JIS standard (see JIS K-7121). As a result, a change in stepwise endothermic amount without showing a clear peak is observed. The glass transition temperature (Tg) determined by employing the intermediate point in the change of the stepwise endothermic amount is 60° C.

Synthesis of Amorphous Polyester Resin (2)

An amorphous polyester resin (2) is synthesized in the same manner as that of the amorphous polyester resin (1) except that 50 parts by mole of polyoxyethylene(2,0)-2,2-bis (4-hydroxyphenyl)propane, 40 parts by mole of polyoxypropylene(2,2)-2,2-bis(4-hydroxyphenyl)propane, 10 parts by mole of ethylene glycol, 50 parts by mole of terephthalic acid, 15 parts by mole of isophthalic acid, 30 parts by mole of dodecenylsuccinic acid, and 5 parts by mole of 1,2,4-trimellitic acid are put into a heated and dried two-necked flask. The weight average molecular weight (Mw) of the obtained amorphous polyester resin (2) is 12,000. Further, the acid value of the amorphous polyester resin (2) is 21 mg KOH/g. Further, the melting point of the amorphous polyester resin (2) is obtained through measurement using a differential scanning calorimeter (DSC). As a result, a change in stepwise endothermic amount without showing a clear peak is observed. The glass transition temperature (Tg) determined by employing the intermediate point in the change of the stepwise endothermic amount is 65° C.

Synthesis of Crystalline Polyester Resin (1)

43.4 parts by weight of dimethyl sebacate, 32.8 parts by weight of 1,10-decanediol, and 27 parts by weight of dimethyl sulfoxide, and 0.03 parts by weight of dibutyl tin oxide as a catalyst are put into a heated and dried three-necked flask, nitrogen gas is introduced into the container so that the air is changed into an inert atmosphere by a decompression operation, and then 4 hours of mechanical stirring is performed at 180° C. Under the reduced pressure, dimethyl sulfoxide is distilled, the temperature therein is gradually increased to 220° C. under the reduced pressure, stirring is performed for 1.5 hours, the air is cooled when the contents in the container enters a viscous state, and the reaction is stopped, and then 65 part by weight of an aliphatic crystalline polyester resin (1) is synthesized. When the molecular weight is measured in the same manner as that of the amorphous polyester resin (1), the weight average molecular weight (Mw) of the obtained crystalline polyester resin (1) is 22,000. Further, when the melting point is measured in the same manner as that of the amorphous polyester resin (1) and the DSC spectrum is obtained, the crystalline polyester resin (1) shows a clear peak and the melting temperature (Tml) is 77° C.

Example 1

Preparation of Liquid Developer 1

40 parts by weight of a cyan pigment C.I. Pigment Blue 15:3 (manufactured by Clariant, Ltd.) is added to 60 parts by weight of styrene-acrylic resin (manufactured by Fujikura Kasei Co., Ltd., weight average molecular weight: 380,000), and the mixture is kneaded by a pressure kneader. The kneaded material is coarsely ground and a cyan pigment Masterbatch is prepared. Next, a mixture having the following composition is dissolved and dispersed using a ball mill for 24 hours.

The above-described cyan pigment Masterbatch: 25 parts by weight

Styrene-acrylic resin (manufactured by Fujikura Kasei Co., Ltd., styrene-acrylic acid butyl resin, weight average molecular weight: 320,000, acid value: 10): 60 parts by weight Oxazoline group-containing resin (styrene-acrylic resin, manufactured by Nippon Shokubai Co., Ltd., EPOCROS RPS, weight average molecular weight: 130,000): 15 parts by weight Ethyl acetate: 200 parts by weight 20 parts by weight of calcium carbonate (manufactured by Maruo Calcium Co., Ltd., Luminous) is added to, as a dispersion stabilizer, an aqueous solution obtained by dissolving 20 parts by weight of sodium chloride (manufactured by Wako Pure Chemical Industries, Ltd.) in 135 parts by weight of ion exchange water, and the solution is dispersed using a ball mill for 24 hours to be used as a dispersion medium. 100 parts by weight of the mixture is put into 170 parts by weight of the dispersion medium and emulsified using emulsification devices (manufactured by SMT, Inc. and manufactured by IKA, Inc., HIGH-FLEX HOMOGENIZER Ultra-Turrax T-25) at 8,000 rpm and 24,000 rpm for 1 minute, thereby obtaining a suspension. The suspension is put into a separable flask including a stirrer, a thermometer, a cooling tube, and a nitrogen inlet tube, the pressure of the inside of the system is reduced using a vacuum pump, stirring is performed at 35° C. for 3 hours, and ethyl acetate is removed. The resultant is cooled to 20° C., calcium carbonate is decomposed by adding a 10% hydrochloric acid aqueous solution to the reaction solution, and solid-liquid separation is performed by centrifugation. The obtained particles are repeatedly washed by 1,000 parts by weight of ion exchange water for three times and obtained particles are dried in a vacuum at 35° C. A mixture of 103 parts by weight of hardly volatile paraffin oil (manufactured by Matsumura Oil Research, P-40), 1.5 parts by weight of a dispersant (manufactured by Lubrizol Corporation, 13940), and 35 parts by weight of dried cyan particles are finely pulverized using a ball mill, thereby obtaining a liquid developer 1 having a volume average particle diameter of 1.0

In addition, toner particles can be collected from the liquid developer by the following method. The liquid developer is precipitated by centrifugation (1,000 rpm×5 minutes), the supernatant solution is removed by decantation, and toner particles are taken out. The taken out toner particles are washed by hexane or Isopar (the mixed solvent may be appropriately changed by a toner resin).

The acid value of the resin is calculated from the consumed amount of an N/10 potassium hydroxide/alcohol solution by dissolving 10 mg of a sample in 50 mL of toluene and performing titration by a standardized N/10 potassium hydroxide/alcohol solution using a mixed indicator of 0.1% of bromothymol blue and phenyl red.

Evaluation of Fixing Property

Fixing Method

A patch image having an image density of 1.0 is output to coated paper (Oji Paper Co., Ltd. OK Topcoat 128) using the liquid developer 1, the image forming apparatus illustrated in FIG. 1, and an OPC photoreceptor (Fuji Xerox Co., Ltd., drum corresponding to DocuPrint C5450) as a photoreceptor.

The image is fixed by appropriately changing the roll temperature of a fixing device of the image forming apparatus from 110° C. to 180° C. by 5° C., thereby obtaining a fixed image. The sheet transporting speed is set to 40 m per minute. Further, the temperature of a heating device is set to 160° C. Crosslinking occurring in the image after the heating treatment is confirmed through observation of disappearing of an imine (C═N) peak at 1680 $cm^{-1}$ and appearing of an amide (—C(═O)—NH—) peak at 1700 $cm^{-1}$ using a Fourier transform infrared spectrometer (manufactured by Horiba, Ltd., FT730 type). The evaluation results are listed in Table 1.

Method of Evaluating Hot Offset

Present of generated hot offset is determined through visual inspection for evaluation of image intensity. Evaluation is performed based on the following criteria.

A: Generation of hot offset is not visually confirmed.

B: Generation of hot offset is slightly visually confirmed, but the image is not almost deteriorated.

C: Generation of hot offset accompanied by image deterioration is visually confirmed.

Method of Evaluating Document Offset

For evaluation of image storability, fixed images formed using a developer are superimposed each other, a load of 80 g/$cm^2$ is applied thereto, the images are kept in a chamber in an environment of a temperature of 55° C. and a humidity of 60% for 7 days, and the document offset of the images is evaluated. Evaluation is performed based on the following criteria.

AA: The image is peeled off without applying a force.

A: A force is applied for peeling the image, but the image is not almost deteriorated.

C: The image is deteriorated.

Example 2

Preparation of Liquid Developer 2

40 parts by weight of a yellow pigment (C.I. Pigment Yellow 185, manufactured by BASF Japan, Ltd.) is added to 60 parts by weight of the amorphous polyester resin (1), and the mixture is kneaded by a pressure kneader. The kneaded material is coarsely ground and a yellow pigment Masterbatch is prepared. Next, a mixture having the following composition is put into a sealed reaction container in which a dissolver is installed and is dissolved and dispersed for 3 hours while warming at a temperature of 40° C.

The above-described yellow pigment Masterbatch: 25 parts by weight

Amorphous polyester resin (2): 45 parts by weight

Crystalline polyester resin (1): 20 parts by weight

Oxazoline group-containing resin (manufactured by Nippon Shokubai Co., Ltd., EPOCROS RPS): 10 parts by weight Ethyl acetate: 400 parts by weight 30 parts by weight of calcium carbonate (manufactured by Maruo Calcium Co., Ltd., Luminous) and 3.5 parts by weight of carboxy methyl cellulose (manufactured by Dai-ichi Kogyo Seiyaku Co., Ltd., Cellogen) are added to, as a dispersion stabilizer, an aqueous solution obtained by dissolving 28 parts by weight of sodium chloride (manufactured by Wako Pure Chemical Industries, Ltd.) in 160 parts by weight of ion exchange water, and the solution is dispersed using a ball mill for 24 hours to be used as a dispersion medium. 120 parts by weight of the mixture is put into 200 parts by weight of the dispersion medium and emulsified using an emulsification device (manufactured by IKA, Inc., Ultra-Turrax T-50) at 10,000 rpm for 3 minutes, thereby obtaining an emulsion. The emulsion is moved to a container in which a stirrer is installed, ethyl acetate is removed by blowing nitrogen, and calcium carbonate is decomposed by hydrochloric acid, thereby obtaining a suspension of toner particles. Toner particles are separated from the suspension of the toner particles by centrifugation, and washed with ion exchange water. 100 parts by weight of washed toner particles are re-dispersed using a homogenizer by adding ion exchange water such that the solid content concentration thereof becomes 15% by weight. 4.0 parts by weight of a polyethylene imide aqueous solution (manufactured by Wako Pure Chemical Industries, Ltd., weight average molecular weight: 70,000, solid content concentration: 30% by weight) is added to the dispersion as a polyamine compound, and the mixture is stirred using a propeller type stirrer for 1 hour. Next, toner particles are separated by centrifugation, washed with ion exchange water, dried in a vacuum at 40° C., and toner particles having a volume average particle diameter of 3.8 μm are obtained. 70 parts by weight of silicone oil (manufactured by Shin-Etsu Chemical Co., Ltd., KF96-20CS) and 0.1 parts by weight of carboxy-modified silicone oil (manufactured by Shin-Etsu Chemical Co., Ltd., X22-3701E) are mixed with 30 parts by weight of the obtained toner particles, and a liquid developer 2 in which toner particles are dispersed is obtained. Evaluation is performed in the same manner as that of Example 1 except that a-Si photoreceptor (manufactured by KYOCERA Corporation) is used as a photoreceptor. The evaluation results are listed in Table 1.

Example 3

Preparation of Liquid Developer 3

20 parts by weight of a magenta pigment (C.I. Pigment Red 122, manufactured by Clariant, Ltd.) and 20 parts by weight of C.I. Pigment Red 57:1 (manufactured by Dainichiseika Color & Chemicals Mfg. Co., Ltd.) are added to 60 parts by weight of the amorphous polyester resin (1), and the mixture is kneaded by a pressure kneader. The kneaded material is coarsely ground and a magenta pigment Masterbatch is prepared. Next, a mixture having the following composition is put into a sealed reaction container in which a dissolver is installed and is dissolved and dispersed for 1 hour while refluxing at a temperature of 80° C.

The above-described magenta pigment Masterbatch: 25 parts by weight

Amorphous polyester resin (2): 45 parts by weight

Crystalline polyester resin (1): 20 parts by weight

Methyl ethyl ketone: 100 parts by weight

The temperature of the dispersion is cooled to 25° C., 26 parts by weight of 1.5% ammonia water is gradually added thereto, and the solution is maintained at a temperature of 25° C. and stirred at 4,000 rpm. 200 parts by weight of ion exchange water is gradually added dropwise thereof, and phase inversion emulsification is performed. Next, 0.25 parts by weight of a surfactant (manufactured by Kao Corporation, PELEX CS) is added and 25 parts by weight of an oxazoline group-containing resin emulsion (manufactured by Nippon Shokubai Co., Ltd., K1030E, solid content concentration: 40% by weight, weight average molecular weight: 20,000) is added thereto, the stirring rotation speed is dropped to 500 rpm, 38 parts by weight of a 5% sodium sulfate aqueous solution is gradually added dropwise, and particles are aggregated and integrated. Further, the particles are stabilized by adding 200 parts by weight of ion exchange water. While the container is warmed, the pressure inside of the reaction container is reduced by a vacuum pump and methyl ethyl ketone is removed. After the reaction solution is cooled, the particles are separated by centrifugation and washed with ion exchange water. 100 parts by weight of washed toner particles are re-dispersed using a homogenizer by adding ion exchange water such that the solid content concentration thereof becomes 15% by weight. 4.0 parts by weight of a polyethylene imine aqueous solution (manufactured by Wako Pure Chemical Industries, Ltd., weight average molecular weight: 70,000, solid content concentration: 30% by weight) is added to the dispersion as a polyamine compound, and the mixture is stirred using a propeller type stirrer for 1 hour. Next, toner particles are separated by centrifugation, washed with ion exchange water, dried in a vacuum at 40° C., and toner particles having a volume average particle diameter of 2.5 μm are obtained. 70 parts by weight of silicone oil (manufactured by Shin-Etsu Chemical Co., Ltd., KF96-20CS) and 0.1 parts by weight of carboxy-modified silicone oil (manufactured by Shin-Etsu Chemical Co., Ltd., X22-3701E) are mixed with 30 parts by weight of the obtained toner particles, and a liquid developer 3 in which toner particles are dispersed is obtained. Evaluation is performed in the same manner as that of Example 1 except that a-Si photoreceptor (manufactured by KYOCERA Corporation) is used as a photoreceptor. The evaluation results are listed in Table 1.

Example 4

Preparation of Dispersion of Crystalline Polyester Resin Particle 160 parts by weight of the crystalline polyester resin (1), 233 parts by weight of ethyl acetate, and 0.1 parts by weight of sodium hydroxide aqueous solution (0.3 N) are prepared, put into a separable flask, heated at 75° C., and stirred using a three-one motor (manufactured by Shinto Scientific Co., Ltd.), thereby preparing a resin mixed liquid. The resin mixed liquid is further stirred, 373 parts by weight of ion exchange water is gradually added, phase inversion emulsification is performed, and the temperature is decreased to 40° C. at a temperature dropping rate of 10° C./min, thereby obtaining a dispersion of crystalline polyester resin particles (solid content concentration: 30% by weight) by removing the solvent.

Preparation of Dispersion of Amorphous Polyester Resin Particle 160 parts by weight of the amorphous polyester resin (1), 233 parts by weight of ethyl acetate, and 0.1 parts by weight of sodium hydroxide aqueous solution (0.3 N) are prepared, put into a separable flask, heated at 70° C., and stirred using a three-one motor (manufactured by Shinto Scientific Co., Ltd.), thereby preparing a resin mixed liquid. The resin mixed liquid is further stirred, 373 parts by weight of ion exchange water is gradually added, phase inversion emulsification is performed, and the temperature is decreased to 40° C. at a temperature dropping rate of 1° C./min, thereby obtaining a dispersion of amorphous polyester resin particles (solid content concentration: 30% by weight) by removing the solvent.

Preparation of Colorant Dispersion

Cyan pigment (C.I. Pigment blue 15:3, manufactured by Dainichiseika Color & Chemicals Mfg. Co., Ltd.): 45 parts by weight Ioninc surfactant (Neogen RK, manufactured by Dai-ichi Kogyo Seiyaku Co., Ltd.): 5 parts by weight Ion exchange water: 200 parts by weight The above-described components are mixed, dissolved, and dispersed using a homogenizer (IKA Ultra-Turrax T-50) for 10 minutes, thereby obtaining a colorant dispersion having a volume average particle diameter of 170 nm.

Preparation of Wax Dispersion

Paraffin wax (melting temperature: 69° C., manufactured by Wako Pure Chemical Industries, Ltd.): 45 parts by weight Cationic surfactant (Neogen RK, manufactured by Dai-ichi Kogyo Seiyaku Co., Ltd.): 5 parts by weight Ion exchange water: 200 parts by weight The above-described components are heated at 90° C., sufficiently dispersed using a homogenizer (IKA Ultra-Turrax T-50), and subjected to a dispersion treatment using a pressure discharge type Gaulin homogenizer, thereby obtaining a wax dispersion having a volume average particle diameter of 200 nm and a solid content of 24.3% by weight.

Preparation of Liquid Developer 4

Dispersion of crystalline polyester resin particles: 15 parts by weight

Dispersion of amorphous polyester resin particles: 90 parts by weight

Colorant dispersion: 18 parts by weight

Wax dispersion: 18 parts by weight

Ion exchange water is added to the above-described components such that the solid content becomes 16% by weight, and the mixture is sufficiently mixed in a round stainless steel flask in an Ultra-Turrax T50 and dispersed. Next, 0.36 parts by weight of polyaluminum chloride is added, and 40 parts by weight of an oxazoline group-containing resin emulsion (manufactured by Nippon Shokubai Co., Ltd., K1030E, solid content concentration: 40% by weight) is added thereto, and a dispersion operation is continued by the Ultra-Turrax T50. The flask is stirred with an oil bath for heating and heated to 37° C. The flask is maintained at 37° C. for 60 minutes, the pH in the system is adjusted to 9.0 using a 0.55 mole/L sodium hydroxide aqueous solution, the stainless steel flask is sealed, stirring is continued using a magnetic seal, the temperature is increased to 90° C., and then the flask is maintained for 3.5 hours. When the particle diameter is measured at this time, the volume average particle diameter is 2.8 μm, the volume average particle size distribution index GSDv is 1.24, and the number average particle size distribution index GSDp is 1.30. After the above-described treatment is completed, the solution is cooled, filtered, and sufficiently washed with ion exchange water, and solid-liquid separation is performed by Nutsche suction filtration. The resultant is re-dispersed using 3 L of ion exchange water at 40° C., stirred at 300 rpm for 15 minutes, and then washed. This operation is repeatedly performed 5 times and solid-liquid separation is performed by Nutsche suction filtration using filter paper No. 4A when the electric conductivity of the filtrate becomes 9.7 μS/cm. 100 parts by weight of washed toner particles are re-dispersed using a homogenizer by adding ion exchange water such that the solid content concentration thereof becomes 15% by weight. 8.0 parts by weight of a polyallyl amine aqueous solution (manufactured by Nittobo Medical, Inc., PAA, weight average molecular weight: 15,000, solid content concentration: 15% by weight) is added to the dispersion as a polyamine compound, and the mixture is stirred using a propeller type stirrer for 1 hour. Next, toner particles are separated by centrifugation, washed with ion exchange water, dried in a vacuum at 40° C., and toner particles having a volume average particle diameter of 2.8 μl are obtained. 40 parts by weight of silicone oil (manufactured by Shin-Etsu Chemical Co., Ltd., KF96-20CS), 30 parts by weight of paraffin oil (manufactured by Matsumura Oil Company, P-40), and 0.1 parts by weight of carboxy-modified silicone oil (manufactured by Shin-Etsu Chemical Co., Ltd., X22-3701E) are mixed with 30 parts by weight of the obtained toner particles, and a liquid developer 4 in which toner particles are dispersed is obtained. Evaluation is performed in the same manner as that of Example 1 except that a-Si photoreceptor (manufactured by KYOCERA Corporation) is used as a photoreceptor. The evaluation results are listed in Table 1.

Example 5

A liquid developer 5 is obtained in the same manner as that of Example 2 except that the crystalline polyester resin (1) in Example 2 is changed into the amorphous polyester resin (1). Evaluation is performed in the same manner as that of Example 1. The evaluation results are listed in Table 1.

Example 6

A liquid developer 6 is obtained in the same manner as that of Example 3 except that the entire amorphous polyester resin in Example 3 is replaced with the crystalline polyester resin (1). Evaluation is performed in the same manner as that of Example 1. The evaluation results are listed in Table 1.

Example 7

A liquid developer 7 is obtained in the same manner as that of Example 2 except that polyethylene imine aqueous solution of a polyamine compound in Example 2 is not used. Evaluation is performed in the same manner as that of Example 1. The evaluation results are listed in Table 1.

Example 8

A liquid developer 8 is obtained in the same manner as that of Example 2 except that soybean oil (manufactured by J-oil Mills, Inc., trade name: "SOYBEAN OIL," iodine value: 115) is used instead of 70 parts by weight of silicone oil (manufactured by Shin-Etsu Chemical Co., Ltd., KF96-20CS) and 0.1 parts by weight of carboxy-modified silicone oil (manufactured by Shin-Etsu Chemical Co., Ltd., X22-3701E) in Example 2. Evaluation is performed in the same manner as that of Example 1. The evaluation results are listed in Table 1.

Example 9

A dry toner obtained in Example 1 is classified to prepare a try toner having a volume average particle diameter of 6 μm, and a developer is obtained. Evaluation is performed in the same manner as that of Example 1. The evaluation results are listed in Table 1.

Comparative Example 1

Evaluation is performed in the same manner as that of Example 1 except that the heating treatment is not performed. The evaluation results are listed in Table 1.

Comparative Example 2

A liquid developer 9 is obtained in the same manner as that of Example 1 except that an oxazoline group-containing resin in Example 1 is changed into a crystalline polyester resin (1). Evaluation is performed in the same manner as that of Example 1. The evaluation results are listed in Table 1.

TABLE 1

| | Carboxyl group-containing resin | Oxazoline group-containing resin | Surface treatment | photo-receptor | Developer | Heating treatment | Evaluation | |
|---|---|---|---|---|---|---|---|---|
| | | | | | | | Hot offset | Document offset |
| Example 1 | Styrene-acrylic resin | EPOCROS RPS | None | OPC | Paraffin oil | Performed | A | A |
| Example 2 | Amorphous polyester resins (1) and (2) Crystalline polyester resin (1) | EPOCROS RPS | Polyethylene-imine | a-Si | Silicone oil | Performed | A | AA |
| Example 3 | Amorphous polyester resins (1) and (2) Crystalline polyester resin (1) | K1030E | Polyethylene-imine | a-Si | Silicone oil | Performed | A | AA |
| Example 4 | Amorphous polyester resin (1) Crystalline polyester resin (1) | K1030E | Polyethylene-amine | a-Si | Silicone oil | Performed | A | AA |
| Example 5 | Amorphous polyester resins (1) and (2) | EPOCROS RPS | Polyethylene-imine | a-Si | Silicone oil | Performed | A | A |
| Example 6 | Crystalline polyester resin (1) | K1030E | Polyethylene-imine | a-Si | Silicone oil | Performed | A | A |
| Example 7 | Amorphous polyester resins (1) and (2) Crystalline polyester resin (1) | EPOCROS RPS | None | a-Si | Silicone oil | Performed | B | A |

TABLE 1-continued

| | Carboxyl group-containing resin | Oxazoline group-containing resin | Surface treatment | photo-receptor | Developer | Heating treatment | Evaluation Hot offset | Evaluation Document offset |
|---|---|---|---|---|---|---|---|---|
| Example 8 | Amorphous polyester resins (1) and (2) Crystalline polyester resin (1) | EPOCROS RPS | Polyethylene-imine | a-Si | Soybean oil | Performed | A | A |
| Example 9 | Amorphous polyester resins (1) and (2) Crystalline polyester resin (1) | EPOCROS RPS | Polyethylene-imine | a-Si | Dry type | Performed | A | A |
| Comparative Example 1 | Styrene-acrylic resin | EPOCROS RPS | None | OPC | Paraffin oil | Not performed | A | C |
| Comparative Example 2 | Styrene-acrylic resin Crystalline polyester resin (1) | None | None | OPC | Paraffin oil | Performed | A | C |

As described above, in the image forming method of Examples, both of image storability and image intensity are achieved compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming method comprising:

forming an unfixed toner image on a recording medium using a toner that contains a carboxyl group-containing resin having a carboxyl group and an oxazoline group-containing resin having an oxazoline group, wherein a molar amount of the oxazoline group in the oxazoline group-containing resin is in a range from an equimolar amount to 10 times a molar amount of the carboxyl group in the carboxyl group-containing resin;

fixing the unfixed toner image to the recording medium to form a fixed toner image; and performing a heat treatment on the fixed toner image at a temperature greater than or equal to a fixing temperature.

2. The image forming method according to claim 1, wherein the carboxyl group-containing resin contains a crystalline polyester resin and an amorphous polyester resin.

3. The image forming method according to claim 2, wherein a surface of the toner is subjected to a surface treatment with a polyamine compound.

4. The image forming method according to claim 2, wherein a liquid developer containing the toner and a carrier liquid is used in the forming of the unfixed toner image.

5. The image forming method according to claim 4, wherein the carrier liquid contains silicone oil as a main component.

6. The image forming method according to claim 5, wherein a surface of the toner is subjected to a surface treatment with a polyamine compound.

7. The image forming method according to claim 4, wherein a surface of the toner is subjected to a surface treatment with a polyamine compound.

8. The image forming method according to claim 1, wherein a liquid developer containing the toner and a carrier liquid is used in the forming of the unfixed toner image.

9. The image forming method according to claim 8, wherein the carrier liquid contains silicone oil as a main component.

10. The image forming method according to claim 9, wherein a surface of the toner is subjected to a surface treatment with a polyamine compound.

11. The image forming method according to claim 8, wherein a surface of the toner is subjected to a surface treatment with a polyamine compound.

12. The image forming method according to claim 1, wherein a surface of the toner is subjected to a surface treatment with a polyamine compound.

* * * * *